US010345084B1

(12) United States Patent
Nance et al.

(10) Patent No.: US 10,345,084 B1
(45) Date of Patent: Jul. 9, 2019

(54) INITIATOR ASSEMBLY WITH EXPLODING FOIL INITIATOR AND DETONATION DETECTION SWITCH

(71) Applicant: Reynolds Systems, Inc., Middletown, CA (US)

(72) Inventors: Christopher J. Nance, Middletown, CA (US); John P. Segal, Middletown, CA (US); Richard K. Reynolds, Middletown, CA (US)

(73) Assignee: Reynolds Systems, Inc., Middletown, CA (US)

( * ) Notice: Subject to any disclaimer, the term of this patent is extended or adjusted under 35 U.S.C. 154(b) by 0 days.

(21) Appl. No.: 15/911,340

(22) Filed: Mar. 5, 2018

Related U.S. Application Data

(60) Provisional application No. 62/486,538, filed on Apr. 18, 2017.

(51) Int. Cl.
*F42B 3/12* (2006.01)

(52) U.S. Cl.
CPC ..... *F42B 3/124* (2013.01); *F42B 3/125* (2013.01)

(58) Field of Classification Search
CPC ..... F42B 3/124; F42B 3/125; F42B 3/12
USPC ..... 102/202.7
See application file for complete search history.

(56) References Cited

U.S. PATENT DOCUMENTS 5,088,413 A * 2/1992 Huber ..... F42B 3/124 102/200
6,158,347 A * 12/2000 Neyer ..... F42B 3/124 102/202.14
6,752,083 B1 * 6/2004 Lerche ..... E21B 43/1185 102/202.5
6,923,122 B2 8/2005 Hennings et al.
7,661,362 B2 2/2010 Hennings et al.
8,210,083 B1 7/2012 Nance et al.
8,408,131 B1 * 4/2013 Nance ..... F42B 3/103 102/202.14
8,485,097 B1 * 7/2013 Nance ..... F42C 19/06 102/200
8,573,122 B1 * 11/2013 Nance ..... F42B 3/12 102/202.5
8,726,808 B1 * 5/2014 Nance ..... F42B 3/10 102/202.14
9,038,538 B1 * 5/2015 Nance ..... F42C 19/0819 102/202.9

(Continued)

*Primary Examiner* — Joshua E Freeman
(74) *Attorney, Agent, or Firm* — Harness, Dickey & Pierce, P.L.C.

(57) ABSTRACT

An initiator assembly that includes an exploding foil initiator, an input charge and a detonation detection switch. The exploding foil initiator has a base, a pair of bridge lands, a bridge element, and a plurality of non-metallic material layers. The bridge lands are coupled to the base. The bridge element is disposed between the bridge lands. The non-metallic material layers form a flyer layer and a barrel. The flyer layer is disposed over the bridge element. The barrel defines a barrel aperture and is disposed over the flyer layer such that the barrel aperture is disposed in-line with the bridge element. The input charge is formed of a secondary explosive, the input charge being disposed in-line with the barrel aperture. The detonation detection switch is mounted to the exploding foil initiator within an area defined by an outer perimeter of the base.

39 Claims, 6 Drawing Sheets

(56) References Cited

U.S. PATENT DOCUMENTS

| | | | | |
|---|---|---|---|---|
| 2004/0107856 | A1* | 6/2004 | Hennings | F42B 3/127<br>102/202.7 |
| 2005/0235858 | A1* | 10/2005 | Reynolds | F42B 3/121<br>102/202.14 |
| 2007/0119325 | A1* | 5/2007 | Hennings | F42B 3/103<br>102/202.9 |
| 2007/0261583 | A1* | 11/2007 | Nance | F42B 3/10<br>102/202.8 |
| 2007/0261584 | A1* | 11/2007 | Nance | F42B 3/124<br>102/202.8 |
| 2008/0134921 | A1* | 6/2008 | Nance | F42B 3/103<br>102/202.5 |
| 2008/0148982 | A1* | 6/2008 | Hennings | F42B 3/124<br>102/202.7 |
| 2009/0151584 | A1* | 6/2009 | Desai | F42B 3/121<br>102/202.7 |
| 2012/0000387 | A1* | 1/2012 | Nance | F42B 3/103<br>102/202.9 |
| 2017/0045342 | A1* | 2/2017 | Fisher | F42B 3/125 |

* cited by examiner

INITIATOR ASSEMBLY WITH EXPLODING FOIL INITIATOR AND DETONATION DETECTION SWITCH

CROSS-REFERENCE TO RELATED APPLICATIONS

This application claims the benefit of U.S. Provisional Patent Application No. 62/486,538 filed Apr. 18, 2017, the disclosure of which is incorporated by reference as if fully set forth in detail herein.

FIELD

The present disclosure relates to an initiator assembly with an exploding foil initiator and a detonation detection switch.

BACKGROUND

This section provides background information related to the present disclosure which is not necessarily prior art.

In modern military munitions that employ an initiator assembly having an exploding foil initiator that is configured to initiate detonation of an input charge that is formed of a high explosive material, it can be desirable to have high-speed feedback in the form of an electronic signal that confirms that the exploding foil initiator had successfully initiated detonation of the input charge. This feedback may be employed, for example, to control the operation of other devices, including other exploding foil initiators. These other devices could be employed to selectively operate a redundant actuator and/or to perform functions such as shaping a detonation wavefront as it travels through a primary charge of high explosive in the munition.

U.S. Pat. No. 8,485,097 discloses an initiator assembly having an exploding foil initiator and a normally open grounding switch. The grounding switch employs energy from a detonating input charge to close the grounding switch, which operates to connect a terminal of the exploding foil initiator to an electrical ground to dissipate excess energy that was applied to the exploding foil initiator. While the grounding switch of the '097 patent works satisfactorily for its intended purpose, it is not capable of closing after the onset of detonation in the input charge as quickly as is desired. Accordingly, there remains a need in the art for an initiator assembly having an exploding foil initiator and a detonation detection switch that is more responsive to the initiation of detonation in an input charge.

SUMMARY

This section provides a general summary of the disclosure, and is not a comprehensive disclosure of its full scope or all of its features.

In one form, the present disclosure provides an initiator assembly that includes an exploding foil initiator, a detonation detection switch and an input charge. The exploding foil initiator has a base, a pair of bridge lands, a bridge element, and a plurality of non-metallic material layers. The bridge lands are coupled to the base. The bridge element is disposed between the bridge lands. The non-metallic material layers form a flyer layer and a barrel. The flyer layer is disposed over the bridge element. The barrel defines a barrel aperture and is disposed over the flyer layer such that the barrel aperture is disposed in-line with the bridge element. The detonation detection switch is coupled to the base of the exploding foil initiator and includes first and second switch lands and a switch shunt. The first and second switch lands are coupled to the base and are spaced apart from one another so as not to be in electrical contact with one another. The switch shunt being fixedly coupled to one of the non-metallic material layers on a side of the one of the non-metallic material layers that faces away from the first and second switch lands so that the one of the non-metallic layers is disposed between the switch shunt and at least one of the first and second switch lands. The switch shunt overlies at least a portion of each of the first and second switch lands. The input charge is formed of a secondary explosive, the input charge being disposed in-line with the barrel aperture. The one of the non-metallic material layers is a dielectric material at standard conditions for temperature and pressure. The one of the non-metallic material layers is also a conductor when subjected to at least one of a shock wave and a compressive stress generated by the input charge when the input charge detonates.

In a further form, the present disclosure provides an initiator assembly that includes an exploding foil initiator, an input charge and a detonation detection switch. The exploding foil initiator has a base, a pair of bridge lands, a bridge element, and a plurality of non-metallic material layers. The bridge lands are coupled to the base. The bridge element is disposed between the bridge lands. The non-metallic material layers form a flyer layer and a barrel. The flyer layer is disposed over the bridge element. The barrel defines a barrel aperture and is disposed over the flyer layer such that the barrel aperture is disposed in-line with the bridge element. The input charge is formed of a secondary explosive, the input charge being disposed in-line with the barrel aperture. The detonation detection switch is mounted to the exploding foil initiator within an area defined by an outer perimeter of the base.

In still another form, the present disclosure provides a method for operating an initiator assembly. The method includes: providing an exploding foil initiator, an input charge and a detonation detection switch, the exploding foil initiator having a base, a pair of bridge lands, a bridge element, and a plurality of non-metallic material layers, the bridge lands being coupled to the base, the bridge element being disposed between the bridge lands, the plurality of non-metallic material layers forming a flyer layer and a barrel, the flyer layer being disposed over the bridge element, the barrel defining a barrel aperture, the barrel being disposed over the flyer layer and positioned such that the barrel aperture is disposed in-line with the bridge element, the input charge being formed of a secondary explosive and disposed in-line with the barrel aperture, the detonation detection switch being mounted to the exploding foil initiator within an area defined by an outer perimeter of the base; operating the exploding foil initiator to detonate the input charge; and changing a state of the detonating detecting switch with energy released from the detonating input charge.

In another form, the present disclosure provides an initiator assembly that includes first and second housing components, an exploding foil initiator, an input charge and a detonation detection switch. The first housing component defines an interior surface. The second housing is component fixedly coupled to the first housing component. The first and second housing components define a cavity. The exploding foil initiator is received in the cavity proximate the interior surface and has a pair of bridge lands, a bridge element, and a plurality of non-metallic material layers. The bridge lands are coupled to the first housing component. The bridge element is disposed between the bridge lands. The plurality of non-metallic material layers form a flyer layer, which is disposed over the bridge element, and a barrel that defines a barrel aperture. The barrel is disposed over the flyer layer and positioned such that the barrel aperture is disposed in-line with the bridge element. The input charge is formed of a secondary explosive and is disposed in the cavity in-line with the barrel aperture. The input charge has an axial end that faces the interior surface. The detonation detection switch is coupled to the first housing component and is disposed in the cavity between the interior surface the axial end of the input charge.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
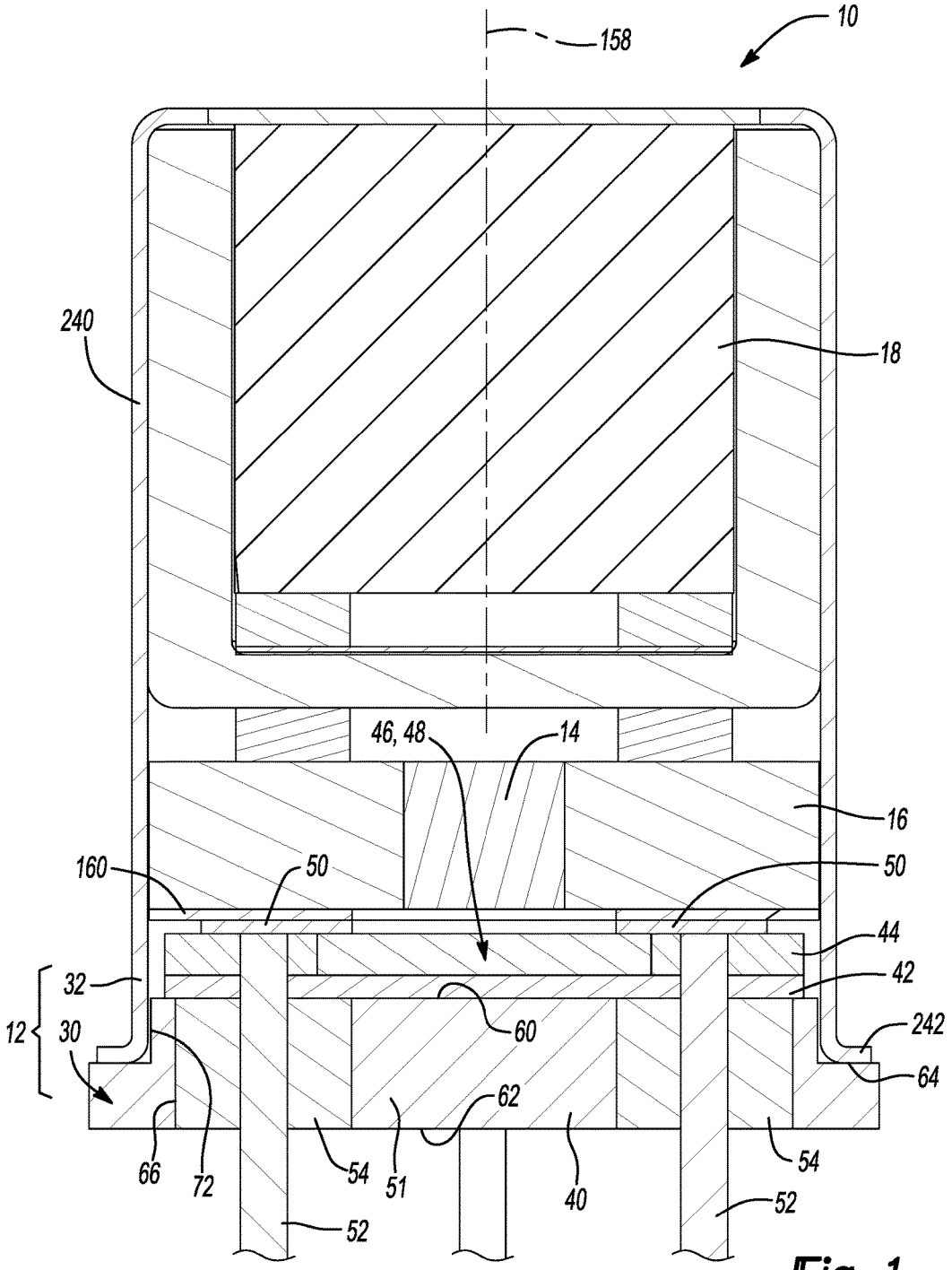
FIG. 1 is a longitudinal cross-section of an exemplary initiator assembly constructed in accordance with the teachings of the present disclosure.
Figure 2:
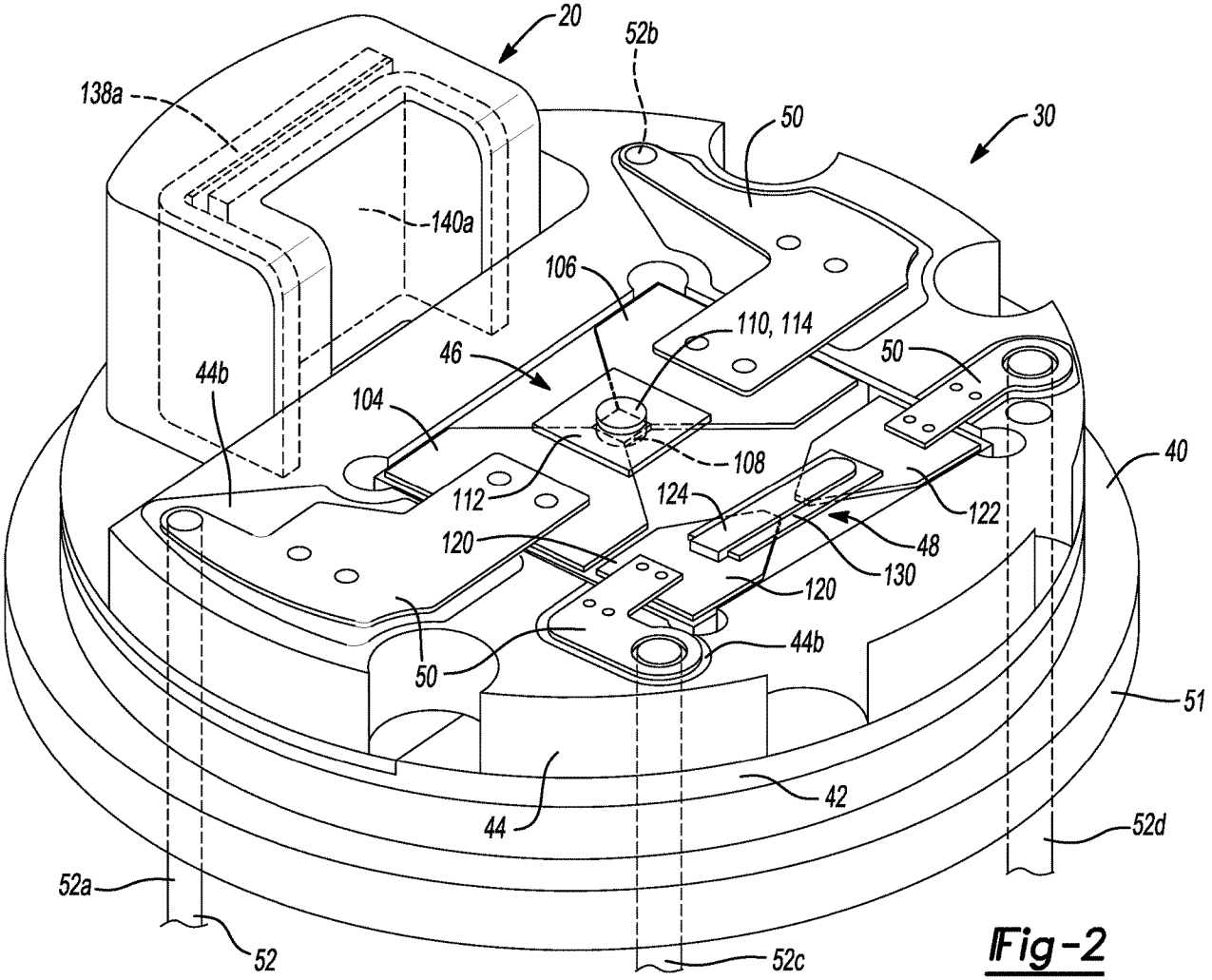
FIG. 2 is a perspective view of a portion of the initiator assembly of FIG. 1 illustrating a header assembly in more detail.

With reference to FIGS. 1 and 2 of the drawings, an initiator assembly constructed in accordance with the teachings of the present invention is generally indicated by reference numeral 10. While the initiator assembly 10 is configured to produce a detonation event or output, the initiator assembly 10 may be any type of initiator assembly and may be configured to initiate a combustion event, a deflagration event and/or a detonation event. Except as noted herein, the initiator assembly 10 can be generally similar to the initiator assembly that is disclosed in U.S. Pat. No. 8,485,097, the disclosure of which is incorporated by reference as if fully set forth in detail herein.

Briefly, the initiator assembly 10 can include a housing assembly 12, an input charge 14, an input sleeve 16, an output charge 18, and an optional grounding switch 20. In the particular example provided, the housing assembly 12 includes a header assembly 30 and a cover 32.

Figure 3:
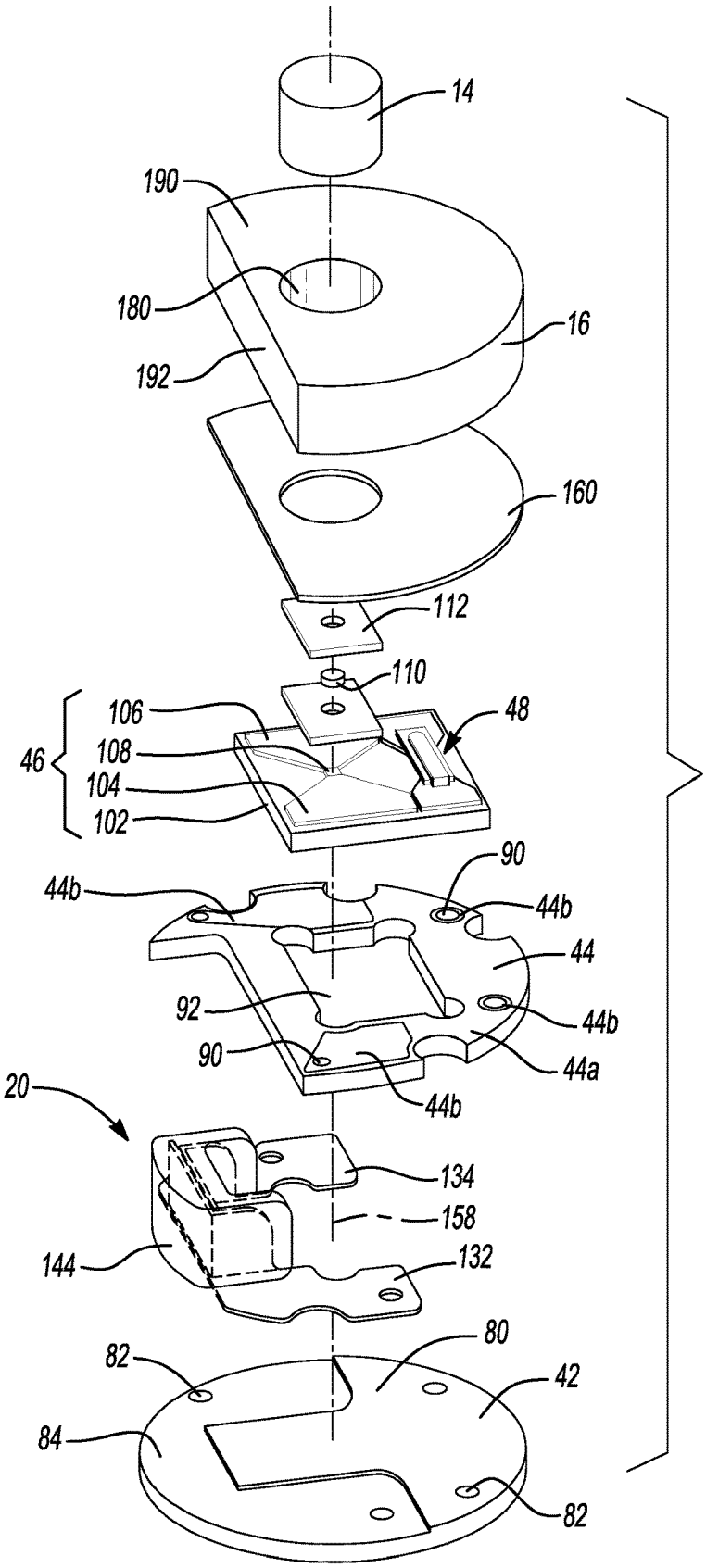
FIG. 3 is an exploded perspective view of a portion of the header assembly.

With reference to FIGS. 1 through 3, the header assembly 30 can include a header 40, an insulating spacer 42, a frame member 44, an exploding foil initiator 46, a detonation detection switch 48 and a plurality of contacts 50. The header 40 can include a header body 51, a plurality of terminals 52, and a plurality of seal members 54.

Returning to FIG. 1, the header body 51 can be formed of an appropriate material, such as KOVAR®, and can be shaped in a desired manner. The header body 51 can define first and second end faces 60 and 62, respectively, a shoulder 64, a plurality of terminal apertures 66. The shoulder 64 can be generally parallel to the first and second end faces 60 and 62 and can abut an annular shoulder wall 72. The shoulder wall 72 can be disposed generally perpendicular to the shoulder 64. The terminal apertures 66 can be formed through the header body 51 generally perpendicular to the first and second end faces 60 and 62.

With reference to FIGS. 1 and 2, a first quantity of the terminals 52 (e.g., terminals 52*a* through 52*d*) can be received in respective ones of the terminal apertures 66 and can extend outwardly from the first and second end faces 60 and 62. It will be appreciated that the terminals 52 can be arranged in a non-symmetrical manner to thereby key the header 40 in a particular orientation relative to a fireset device (not shown) to which the initiator assembly 10 is to be coupled. It will also be appreciated that a keying feature, such as a tab (not shown) or a recess (not shown), can be incorporated into a portion of the header 40 (e.g., the header body 51) to key the header 40 in a particular orientation.

The seal members 54 can be formed of a suitable material, such as glass conforming to 2304 Natural or another dielectric material, and can be received into an associated one of the terminal apertures 66. The seal members 54 can sealingly engage the header body 51 as well as an associated one of the terminals 52.

With reference to FIGS. 1 and 3, the insulating spacer 42 can be formed of a suitable dielectric material, such as polycarbonate, synthetic resin bonded paper (SRBP) or epoxy resin bonded glass fabric (ERBGF), and can define a body 80 having a plurality of clearance apertures 82 that are sized to receive the terminals 52*a* through 52*d* (FIG. 2) therethrough. The body 80 can be received onto the second end face 62 and within an area that is defined by the size (i.e., perimeter) of the shoulder wall 72. The insulating spacer 42 may include a recessed zone 84 that can be configured to receive the grounding switch 20 as will be described in more detail below.

The frame member 44 can include a body 44*a* and a plurality of electrical conductors 44*b*. The body 44*a* can be formed of an appropriate dielectric material, such as synthetic resin bonded paper (SRBP) or epoxy resin bonded glass fabric (ERBGF). The conductors 44*b* can be arranged about the body 44*a* in a predetermined manner and can comprise one or more conductive layers of material, such as gold, silver, copper, nickel and alloys thereof. The conductors 44*b* can be formed onto the body 44*a* in any desired manner, such as through metallization of the entire surface of the body 44*a* and acid-etch removal of portions of the metallization that are not desired. The frame member 44 can be sized and shaped to closely conform to the size and shape of the insulating spacer 42 and can include a plurality of terminal apertures 90 and an interior aperture 92 that is sized to receive the exploding foil initiator 46. The terminal apertures 90 can be sized to receive a corresponding one of the terminals 52 (e.g., terminals 52*a* through 52*c* in FIG. 1)

therein. While the frame member 44 is illustrated as including terminal apertures 90 for only a portion of those terminals 52 that penetrate through the header 40, it will be appreciated that the frame member 44 could be configured differently.

Figure 4:
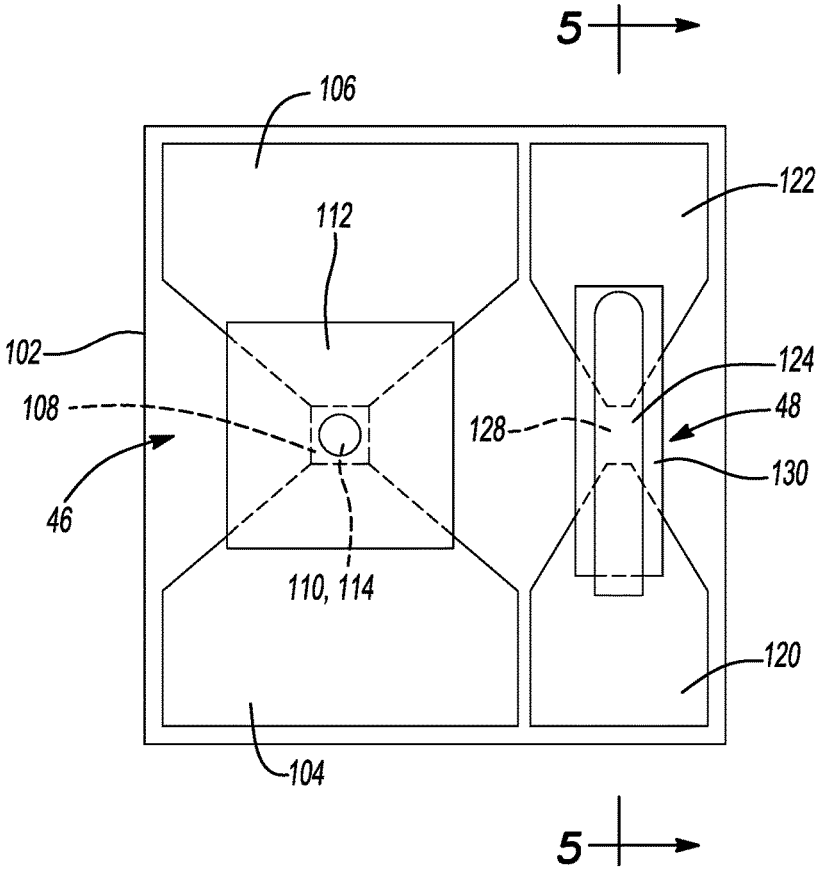
FIG. 4 is a top plan view of a portion of the header assembly, illustrating an exploding foil initiator and a detonation detection switch.

With reference to FIGS. 2 through 4, the exploding foil initiator 46 can be conventional in its construction and operation and as such, need not be described in exhaustive detail herein. Briefly, the exploding foil initiator 46 can include a base 102, a pair of bridge lands 104 and 106, a bridge 108, a flyer 110 and a barrel 112. The base 102 can be a structural member that can be formed of a generally non-conductive material, such as a ceramic. The bridge lands 104 and 106 and the bridge 108 can be fixedly coupled to the base 102 in a suitable manner (e.g., via vapor deposition) and can be formed of one or more layers of metallic material, including copper, silver, nickel, gold and alloys thereof. In the particular example provided, the bridge lands 104 and 106 and the bridge 108 are directly mounted to the base 102, but it will be appreciated that if desired, one or both of the bridge lands 104 and 106 and/or the bridge 108 can be mounted fully or partly on another layer of the exploding foil initiator 46 (e.g., a non-metal material layer that is employed to form the flyer 110 and/or the barrel 112). The bridge 108, which is disposed between the bridge lands 104 and 106, is electrically coupled to the bridge lands 104 and 106 therebetween in the example provided. It will be appreciated, however, that one or more of the bridge lands 104 and 106 can be electrically isolated from the bridge 108 if desired. Examples of configurations where the bridge 108 is electrically isolated from one or more of the lands that are disposed in an electric transmission path for power that is employed to vaporize the bridge 108 are disclosed in commonly assigned U.S. Pat. No. 7,543,532 issued Jun. 9, 2009 entitled "Full Function Initiator With Integrated Planar Switch" and U.S. Pat. No. 9,500,448 issued Nov. 22, 2016 entitled "Bursting Switch", the disclosures of which are incorporated by reference as if fully set forth in detail herein.

The flyer 110 can be formed of a suitable non-metal material layer, while the barrel 112 can be formed of another non-metal material layer that can be deposited or overlaid onto the non-metal material layer that forms the flyer 110. The non-metal material layer that forms the flyer 110 can be deposited over the bridge 108 on a side of the bridge 108 that faces away from the base 102. The barrel 112 can define a barrel aperture 114 that can be located in-line with the flyer 110 and the bridge 108.

The non-metal material layer that forms the flyer 110 (hereinafter "the first non-metal material layer") and the non-metal material layer that forms the barrel 112 (hereinafter "the second non-metal material layer") can be formed of an appropriate material that is electrically insulating prior to detonation of the input charge 14. At least one of the first and second non-metal material layers can have varying electrical properties. Specifically, the at least one of the first and second non-metal material layers that has varying electrical properties (hereinafter "the non-metal material layer with varying electrical properties") can be a dielectric at standard pressure and temperature (i.e., an absolute pressure of 1 atmosphere and a temperature of 0° C.), but can become conductive in response to a shockwave and/or compressive stress generated when the input charge 14 detonates. One exemplary material having these characteristics is polyimide.

The detonation detection switch 48 can include a first switch land 120, a second switch land 122 and a switch shunt 124. The first and second switch lands 120 and 122 can be coupled to the base 102 and can be formed similar to the first and second bridge lands 104 and 106. In the particular example provided, the first and second switch lands 120 and 122 are directly mounted to the base 102, but it will be appreciated that if desired, one or both of the first and second switch lands 120 and 122 can be mounted fully or partly on another layer of the exploding foil initiator 46 (e.g., on a non-metal material layer that forms the flyer 110 or the barrel 112). The first and second switch lands 120 and 122 can be spaced apart from one another (via a gap 128) so that they are not electrically connected to one another. At least one non-metal material layer with varying electrical properties can be disposed over a portion of the second switch land 122. The at least one non-metal material layer with varying electrical properties can be formed of polyamide or poly 4,4'-oxydiphenylene-pyromellitimide (e.g., KAPTON®), for example, and can be deposited over the second switch land via spin-coating. It will be appreciated that the thickness of the at least one non-metal material layer with varying electrical properties can be relatively thin, such as 4 to 8 microns in thickness.

Figure 5:
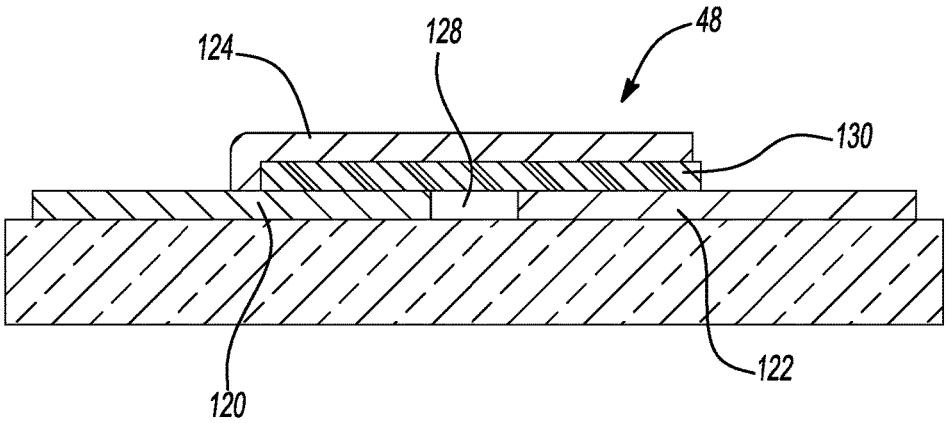
FIG. 5 is a cross-sectional view taken along the line 5-5 of FIG. 4.

With reference to FIGS. 4 and 5, the switch shunt 124 can be disposed over a portion of the first switch land 120 and over a portion of the at least one non-metal material layer with varying electrical properties 130 so that a portion of the switch shunt 124 overlies but is spaced vertically apart from a portion of the second switch land 122. Accordingly, the switch shunt 124 is electrically coupled to the first switch land 120 but not to the second switch land 122 (at standard pressure and temperature and therefore at times prior to the detonation of the input charge 14) due to the presence of the at least one non-metal material layer with varying electrical properties 130 between the switch shunt 124 and the second switch land 122.

With reference to FIGS. 2 and 3, the exploding foil initiator 46 (with the detonation detection switch 48 mounted thereto) can be received in the interior aperture 92 that is formed by the frame member 44 and the exploding foil initiator 46 (with the detonation detection switch 48 mounted thereto) can be bonded to the frame member 44, the insulating spacer 42 and the header body 51.

With reference to FIG. 2, each of the contacts 50 can be formed of a suitable electrically conductive material, such as KOVAR®, and can electrically couple an associated one of the terminals 50 to an associated one of the bridge lands 104 and 106 or to an associated one of the first and second switch lands 120 and 122. In the example provided, each of the contacts 50 is soldered to an associated one of the terminals 52 and either an associated one of the bridge lands 104 and 106 or an associated one of the first and second switch lands 120 and 122.

It will be appreciated that the thicknesses of the barrel 112, the contacts 50 and the solder that couples the contacts 50 to the terminals 52 and the lands 104, 106, 120, 122 can be selected to space the bridge 108 apart from the input charge 14 (FIG. 3) by a predetermined spacing, such as about 0.004 inch to about 0.008 inch. It will be also appreciated that it can be important in some situations that the contacts 50 be relatively flat so as not to affect the spacing between the bridge 108 and the input charge 14 (FIG. 3).

Figure 6:
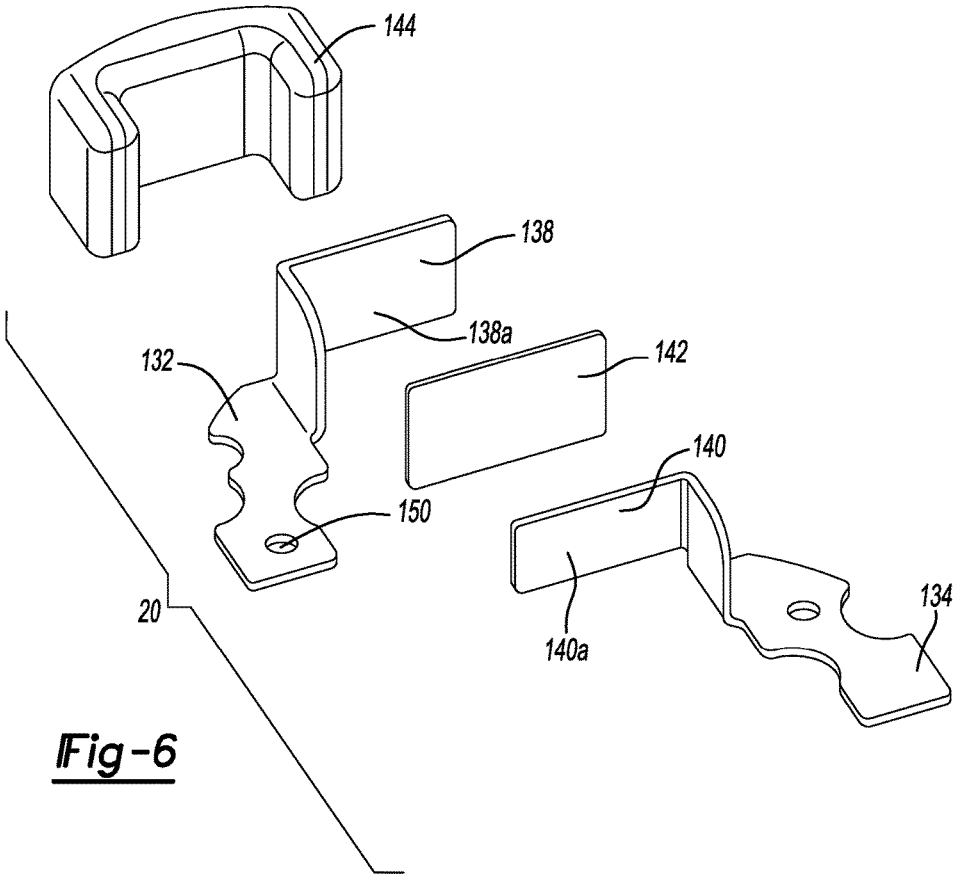
FIG. 6 is an exploded perspective view of a portion of the header assembly illustrating a grounding switch in more detail.

With reference to FIG. 6, the grounding switch 20 can comprise a first grounding contact 132, a second grounding contact 134, a first switch member 138, a second switch member 140, a first insulating member 142 and a second insulating member 144. The first and second grounding contacts 132 and 134 can include flat, planar electrical contacts that can be formed of an appropriate conductive material, such as tin-lead plated copper, and can be received in the recessed zone 84 (FIG. 3) in the insulating spacer 42 (FIG. 3). The depth of the insulating zone 84 (FIG. 3) can be sized to receive all or a portion of the first grounding contact 132 and/or all or a portion of the second grounding contact 134. In the particular example provided, the first and second grounding contacts 132 and 134 are completely received in the recessed zone 84 (FIG. 3) and the depth of the recessed zone 84 (FIG. 3) is sized to match the thickness of the first and second grounding contacts 132 and 134. The first and second grounding contacts 132 and 134 can be configured to be electrically coupled to associated ones of the terminals 52 (FIG. 2). In the particular example provided, the first grounding contact 132 includes a terminal aperture 150 that can be employed to receive the terminal 52*a* (FIG. 2) therethrough, while the second grounding contact 134 can be employed to receive the terminal 52*b* (FIG. 2) therethrough.

The first switch member 138 can be fixedly and electrically coupled to the first grounding contact 132. It will be appreciated that the first grounding contact 132 and the first switch member 138 can be integrally formed from a suitable conductive material. The first switch member 138 can comprise a first conductive target 138*a* that can be configured to extend away from the insulating spacer 42 (FIG. 3) in a desired manner. In the particular example provided, the first conductive target 138*a* is disposed in a plane that is generally parallel to a longitudinal axis 158 (FIG. 3) of the initiator assembly 10 (FIG. 1). The first conductive target 138*a* can extend above the frame member 44 (FIG. 2) so as to lie proximate the input sleeve 16 (FIG. 3).

The second switch member 140 can be fixedly and electrically coupled to the second grounding contact 134. It will be appreciated that the second grounding contact 134 and the second switch member 140 can be integrally formed from a suitable conductive material. The second switch member 140 can comprise a second conductive target 140*a* that can be offset from the first conductive target 138*a* and can be configured to extend away from the insulating spacer 42 (FIG. 3) in a desired manner. In the particular example provided, the second conductive target 140*a* is disposed in a plane that is generally parallel to the longitudinal axis 158 (FIG. 3) of the initiator assembly 10 (FIG. 1). The second conductive target 140*a* can extend above the frame member 44 (FIG. 2) so as to lie proximate the input sleeve 16 (FIG. 3).

The first insulating member 142 can be received between the first and second conductive targets 138*a* and 140*a* and can electrically insulate the first switch member 138 from the second switch member 140. In the particular example provided the first insulating member 142 is sized larger than the first and second conductive targets 138*a* and 140*a* and extends outwardly from the first and second conductive targets 138*a* and 140*a* in vertical and horizontal directions. For example, the first insulating member 142 can be formed of a Kapton film and can have a suitable thickness, such as a thickness of 0.001 inch. It will be appreciated that other types of insulating materials can be employed including air, an inert gas or a vacuum, or that a combination of insulating materials could be employed. The first insulating member 142 can be coupled to the one or both of the first and second switch members 138 and 140 in any desired manner, such as with a suitable adhesive.

The second insulating member 144 can be formed of an electrically insulating material that can be coated, deposited or fitted onto the first and second switch members 138 and 140 to thereby form a barrier that electrically insulates the first and second switch members 138 and 140 from the housing assembly 12 (FIG. 1). In the particular example provided, the second insulating member 144 is formed of LCP and has a thickness of about 0.01 inch, but it will be appreciated that if included, the second insulating member 144 could be thicker or thinner could be thicker. Depending on the particular design, the second insulating member 144 can be employed for one or more functions for the first and second switch members 138 and 140, such as: providing structural support; providing electrical insulation from other components; and/or containment of materials fragmented by the initiator assembly and/or the detonation of the input charge 14 (FIG. 3).

While the first and second switch members 138 and 140 have been shown and described in a particular order (i.e., with the second switch member 140 being radially inward of the first switch member 138), it will be appreciated that the positioning of the first and second switch members 138 and 140 could be reversed (i.e., so that the first switch member 138 is radially inward of the second switch member 140).

With reference to FIG. 3, the input sleeve 16 can be configured to support the input charge 14 and direct energy from the input charge 14 in a desired direction. In the particular example provided, the input sleeve 16 is formed of a suitable structural material, such as steel. The input sleeve 16 can define a cavity 180 that can be located in-line with the bridge 108. The input sleeve 16 can be generally washer-like in shape and can define at least one frangible or structurally weakened zone 190. In the particular example provided, the weakened zone 190 is defined by a flat, planar edge 192 of the input sleeve 16 that extends across the input sleeve 16 generally parallel to a centerline of the cavity 180 and perpendicular to the longitudinal axis 158 (i.e., central axis of the annular or washer shape that defines the remainder of the input sleeve 16) so as to form a span of a relatively narrow width between the cavity 180 and the edge 192. It will be appreciated, however, that the zone 190 could be formed or shaped differently. It will be appreciated that in some applications, the input sleeve 16 may be omitted or may be integrally formed with a structure that also performs some or all of the function of the header body 51. An insulating spacer 160 can be disposed between the input sleeve 16 and the contacts 50.

The input charge 14 can be formed of a suitable energetic material, such as RSI-007, which is a secondary explosive that is available from Reynolds Systems, Inc. of Middletown, Calif. It will be appreciated however that various types of secondary explosives, such as HNS-I, HNS-IV, PETN, NONA, CCLS-20 FPS, and combinations thereof, could be employed for all or a portion of the input charge 14. The input charge 14 can be received in the cavity 180 in the input sleeve 16 and compacted to a desired density. It will be appreciated that in some applications, the input charge 14 may fill the entire volume of the cavity 180.

Returning to FIG. 1, the output charge 18, if included, can be formed from a suitable energetic material, such as another secondary explosive material or a material that may be used for initiating ignition or deflagration in a pyrotechnic material. In the example provided, the output charge 18 is formed from boron potassium nitrate ($BKNO_3$).

The cover 32 can be formed of a suitable material, such as KOVAR®, and can include a cover body 240 and a rim 242. The cover body 240 can be a cup-line structure that can receive annular shoulder wall 72 of the header body 51, as well as the insulating spacer 42, the frame member 44, the exploding foil initiator 46, the detonation detection switch 48, the input sleeve 16, the input charge 14, and if included, the grounding switch 20 and the output charge 18 therein. The rim 242 can extend radially outwardly from the cover body 240 and can matingly engage the shoulder 64 on the header body 51. The rim 242 and the shoulder 64 can be welded in an appropriate manner (e.g., laser welded) to fixedly and sealingly couple the cover 32 to the header body 51.

With renewed reference to FIGS. 2 through 5, when the initiator assembly 10 (FIG. 1) is to be activated, a high current pulse, typically in excess of 1000 amps, is applied to the terminal 52*a*. Although the terminal 52*a* is coupled to the first grounding contact 132 and the terminal 52*b* is coupled to the second grounding contact 134, the first insulating member 142 inhibits the transmission of electrical energy between the first and second switch members 138 and 140 so that the electrical energy cannot be coupled to an electrical ground. As the terminal 52*b* is coupled to an electrical ground, the high current pulse is able to flow through the bridge 108, causing the bridge 108 to vaporize and form a hot, high pressure plasma that shears the flyer 110 from its non-metal material layer and propels the flyer 110 at a relatively high velocity through the barrel aperture 114 in the barrel 112 where it impacts the input charge 14 and causes the input charge 14 to detonate.

Energy released by the detonation of the input charge 14 can be employed to fragment a portion of the input sleeve 16, such as at a portion of the input sleeve 16 proximate the weakened zone 190, and propel the fragmented portion of the input sleeve 16 through the second insulating member 144 and against the first and second switch members 138 and 140 (FIG. 6) to cause electrical contact between the first and second switch members 138 and 140 (FIG. 6), either directly or employing portions of the fragments of the input sleeve 16 as a conductor. For example, the fragmented portion of the input sleeve 16 could penetrate the second insulating member 144, the second switch member 140 (FIG. 6) and the first insulating member 142 (FIG. 6) to electrically couple the first and second switch members 138 and 140 (FIG. 6).

As another example, energy released during the detonation event could be employed to close the grounding switch 20. In this regard, a compressive force, which can be applied to the grounding switch 20 as a result of the detonation event, can cause the second switch member 140 to puncture or travel through the first insulating member 142 (FIG. 6) and electrically contact the first switch member 138 (FIG. 6). Additionally or alternatively, the compressive force applied to the grounding switch 20 could cause the first insulating member 142 (FIG. 6) to temporarily or permanently change from an electric insulator to an electric conductor.

Those of skill in the art will appreciate that residual energy remaining on the terminal 52*a* after vaporization of the bridge 108 can be directed to an electrical ground via a predetermined electrical path by closing the grounding switch 20.

Energy released by the input charge 14 as the input charge 14 starts to detonate, which can take the form of a shock wave or a compressive stress that is applied or transmitted through the non-metal material layer with varying electrical properties 130, can cause the non-metal material layer with varying electrical properties 130 to change from an insulator, which inhibits the transmission of electrical power between the first switch land 120 and the second switch land 122, to a conductor that permits the transmission of electrical power between the first switch land 120 and the second switch land 122. The non-metal material layer with varying electrical properties 130 should be very responsive to the shock wave and/or compressive stress generated by the detonating input charge 14 and as such, the change in the non-metal material layer with varying electrical properties 130 from an electric insulator to an electric conductor should occur within 500 nano-seconds of the initiation of detonation in the input charge 14, preferably within 250 nano-seconds of the initiation of detonation in the input charge 14, and still more preferably within 150 nano-seconds of the initiation of detonation in the input charge 14. Accordingly, a relatively low voltage signal input to the detonation detection switch 48, for example via terminal 52*c* and an associated one of the contacts 50, can be transmitted from the first switch land 120 through the switch shunt 124 and the non-metal layer with varying electrical properties 130, to the second switch land 122 and onto the terminal 52*d* (via another one of the contacts 50). Because of the in-line positioning of the detonation detection switch 48 with the input charge 14, and the fact that energy (from the detonating input charge 14) alone is employed to change the state of the detonation detection switch 48 (i.e., from a normally open state to a closed state in the example provided), the detonation detection switch 48 can change states very rapidly and much more rapidly than the grounding switch 20 is able to close. In this regard, the positioning of the first and second conductive targets 138*a* and 140*a* at locations that are radially offset from both the input charge 14 and the input sleeve 16, the need for portions of the input sleeve 16 to fragment, accelerate and travel to a radially outward location (where the grounding switch 20 is located), as well as the fact that the fragments of the input sleeve 16 travel at approximately one-third the velocity of the velocity with which the detonation wavefront travels through the input charge 14 significantly extends the length of time that is needed to change in the state of the grounding switch 20 (from the normally open state to a closed state) as compared to the length of time that is needed to change the state of the detonation detection switch 48. The delay associated with the change of the switch state in the grounding switch 20 is satisfactory when the function of the switch is to provide a conductive path to dissipate excess energy not used to vaporize the bridge 108, but it is entirely unsatisfactory when the change in the state of the switch were to be used for other functions, such as coordinating the operation of several exploding foil initiators to shape a detonation wavefront through an energetic material (not shown) in a desired manner.

It will be appreciated that the detonation detection switch 48 is a normally open switch that closes in response to energy released by the detonation of the input charge 14. It will also be appreciated that the energy released by the detonation of the input charge 14 will ultimately dissipate and would cause the destruction of both the base 102 of the exploding foil initiator 46 and the detonation detection switch 48. As such, it will be appreciated that during operation of the initiator assembly 10, the detonation detection switch 48 will close briefly or "momentarily" and that any associated controller (not shown) to which the detonation detection switch 48 is coupled would understand the closure of the detonation detection switch 48 as an indication that the input charge 14 had in fact started to detonate.

It will further be appreciated that the function of the grounding switch 20 cannot be directly performed by the detonation detection switch 48 due to the momentary operation of the detonation detection switch 48. In this regard, the detonation detection switch 48 will not be in a closed state for a long enough duration that would permit excess energy on the terminal 52*a* and bridge land 104 to travel to ground.

Figure 7:
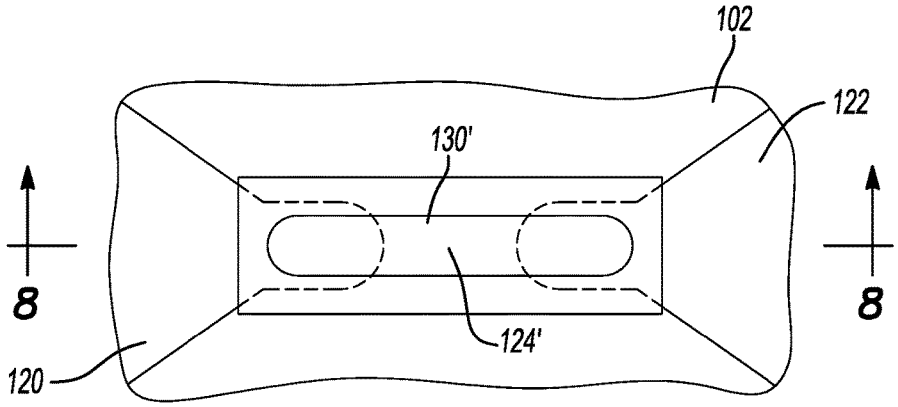
FIG. 7 is a top plan view of an alternately constructed detonation detection switch.
Figure 8:
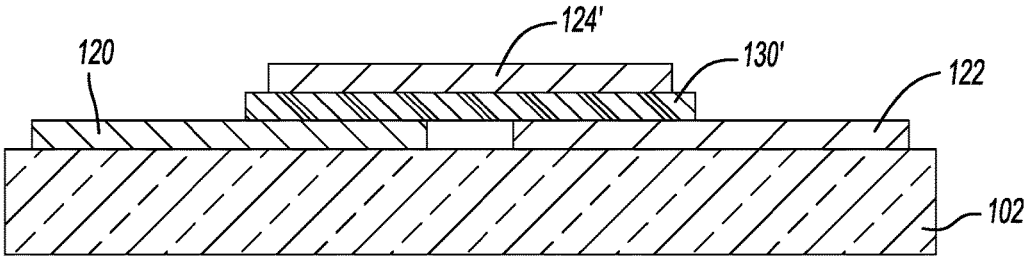
FIG. 8 is a section view taken along the line 8-8 of FIG. 7.

While the detonation detection switch 48 has been illustrated and described as having a switch shunt that is permanently coupled to one of the switch lands, it will be appreciated that the detonation detection switch could be constructed somewhat differently. With reference to FIGS. 7 and 8, the at least one non-metal material layer with varying electrical properties 130' can be disposed between both the first switch land 120 and the second switch land 122, for example. In this example, the switch shunt 124' overlies portions of both the first and second switch lands 120 and 122, but the at least one non-metal material layer with varying electrical properties 130' is disposed vertically between the switch shunt 124' and the first and second switch lands 120 and 122 to thereby electrically isolate the switch shunt 124' from the first and second switch lands 120 and 122. The at least one non-metal material layer with varying electrical properties 130' can change from a dielectric to a conductor in response to energy released from the input charge 14 (FIG. 1) when the input charge 14 (FIG. 1) starts to detonate to electrically couple the first and second switch lands 120 and 122. In this example, electric power would flow from one of the first and second switch lands 120 and 122, through the at least one non-metal material layer with varying electrical properties 130', through the switch shunt 124', back through the at least one non-metal material layer with varying electrical properties 130' and into the other one of the first and second switch lands 120 and 122. It may be possible to eliminate the discrete metal layer that forms the switch shunt 124' in this embodiment, in which case the at least one non-metal material layer with varying electrical properties 130' would be considered to be the switch shunt.

Figure 9:
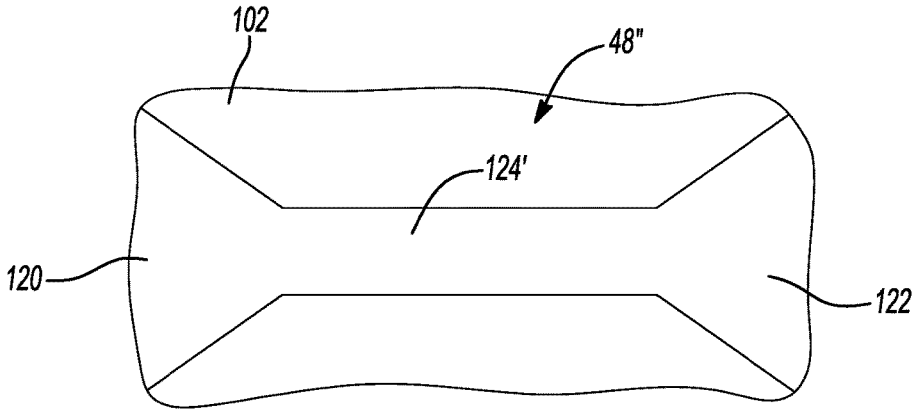
FIG. 9 is a top plan view of another alternately constructed detonation detection switch.

Moreover while the detonation detection switch has been illustrated and described as a normally open switch, it will be appreciated that the detonation detection switch 48" could be configured as a normally closed switch as depicted in FIG. 9. In this example, the switch shunt 124" is electrically coupled to both the first and second switch lands 120 and 122. During the operation of an initiator assembly that employs the detonation detection switch 48", energy released from the input charge 14 (FIG. 1) as the input charge 14 (FIG. 1) detonates would cause the destruction of both the base 102 of the exploding foil initiator 46 (FIG. 2) and the detonation detection switch 48", which would permanently open the detonation detection switch 48". As such, it will be appreciated that during operation of the initiator assembly, the detonation detection switch 48" will switch from a closed state to an open state and that any associated controller (not shown) to which the detonation detection switch 48" is coupled would understand the opening of the detonation detection switch 48" as an indication that the input charge 14 (FIG. 1) had in fact started to detonate.

It will also be appreciated that the switch land 120 could be coupled to (or shared with) the bridge land 104. In this arrangement, excess residual electrical energy on the bridge land 104 after the bridge 108 has been converted into a plasma is employed as an electrical input to the detonation detection switch.

It will further be appreciated that the detonation detection switch could be positioned between the second end face 62 of the header body 51 and the base 102 of the exploding foil initiator 46. More specifically, the detonation detection switch could be formed onto the second end face 62 of the header body 51, the insulating spacer 42, or a side of the base 102 opposite the side on which the bridge 108 is formed.

From the foregoing, it will be appreciated that an initiator assembly constructed in accordance with the present teachings may be equipped with a relatively inexpensive and compact detonation detection switch. The detonation detection switch can be disposed in a volume in a housing assembly between an interior surface of a first component of the housing assembly, such as the first end face 60 (FIG. 1) of the header body 51 (FIG. 1), and an end of the input charge 14 (FIG. 1) that faces the interior surface of the first component of the housing assembly. Moreover, the detonation detection switch can be integrated into the exploding foil initiator 46 (FIG. 4) in a relatively cost-effective manner. In this regard, the base 102 (FIG. 4) can be somewhat larger than what would be required solely for the exploding foil initiator 46 (FIG. 4), but the components of the detonation detection switch 48 (FIG. 4) can be coupled to the base 102 (FIG. 4) and/or formed at times similar to the coupling or formation of various components of the exploding foil initiator 46 (FIG. 4) to minimize or eliminate additional steps that are needed to create the detonation detection switch.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An initiator assembly comprising:

an exploding foil initiator having a base, a pair of bridge lands, a bridge element, and a plurality of non-metallic material layers, the bridge lands being coupled to the base, the bridge element being disposed between the bridge lands, the plurality of non-metallic material layers forming a flyer layer and a barrel, the flyer layer being disposed over the bridge element, the barrel defining a barrel aperture, the barrel being disposed over the flyer layer and positioned such that the barrel aperture is disposed in-line with the bridge element;

an input charge formed of a secondary explosive and disposed in-line with the barrel aperture; and a detonation detection switch that is coupled to the exploding foil initiator.

2. The initiator assembly of claim 1, wherein the detonation detection switch is configured to change from one of a conducting state and a non-conducting state to the other one of the conducting state and the non-conducting state in response to receipt of energy released from the input charge when the input charge is detonated by the exploding foil initiator.

3. The initiator assembly of claim 2, wherein a distance between the base and a point on the detonation detection switch that is furthest from the base has a first magnitude, wherein a distance between the base and a point on the input charge that is furthest from the base has a second magnitude, and wherein the first magnitude is less than the second magnitude.

4. The initiator assembly of claim 2, wherein the detonation detection switch is a normally closed switch.

5. The initiator assembly of claim 4, wherein detonation detection switch comprises a first switch land, a second switch land and a shunt that is coupled to the first and second switch lands and electrically insulated from at least one of the first and second switch lands.

6. The initiator assembly of claim 5, wherein the first and second switch lands and the shut are co-planar.

7. The initiator assembly of claim 2, wherein the detonation detection switch is a normally open switch that closes momentarily when electrical properties of a non-metallic material layer interposed between a shunt and a pair of switch lands switch from dielectric to electrically conductive in response to receipt of energy released from the input charge when the input charge is detonated by the exploding foil initiator.

8. The initiator assembly of claim 7, wherein surfaces of the first and second switch lands that face the non-metallic material layer are disposed in a common plane.

9. The initiator assembly of claim 7, wherein the non-metallic material layer is formed of polyamide.

10. The initiator assembly of claim 2, wherein the pair of bridge lands are directly mounted to the base.

11. The initiator assembly of claim 2, wherein the bridge element is directly mounted to the base.

12. The initiator assembly of claim 2, further comprising an input sleeve and a grounding switch, the input sleeve having a frangible portion, the input charge being received in the input sleeve, the grounding switch comprising first and second conductive targets and a dielectric material disposed between the first and second conductive targets, the grounding switch being disposed proximate the frangible portion, the frangible portion being configured to break apart from a remainder of the input sleeve and impact the grounding switch to electrically couple the first and second conductive targets to one another in response to detonation of the input charge.

13. The initiator assembly of claim 2, wherein the detonation detection switch is mounted to the exploding foil initiator within an area defined by an outer perimeter of the base.

14. The initiator assembly of claim 2, further comprising:

a first housing component that defines an interior surface; and a second housing component fixedly coupled to the first housing component, the first and second housing components defining a cavity;

wherein the exploding foil initiator is received in the cavity proximate the interior surface and the bridge lands are coupled to the first housing component;

wherein the input charge is disposed in the cavity, the input charge having an axial end that faces the interior surface; and wherein the detonation detection switch is coupled to the first housing component and is disposed in the cavity between the interior surface and the axial end of the input charge.

15. The initiator assembly of claim 14, wherein the exploding foil initiator includes a base to which at least one of the bridge contacts is fixedly coupled, and wherein the detonation detection switch is mounted on the base.

16. The initiator assembly of claim 15, wherein the detonation detection switch is a normally closed switch.

17. The initiator assembly of claim 16, wherein detonation detection switch comprises a first switch land, a second switch land and a shunt that is electrically coupled to the first and second switch lands.

18. The initiator assembly of claim 17, wherein the first and second switch lands and the shut are co-planar.

19. The initiator assembly of claim 14, wherein the detonation detection switch is configured to change from one of a conducting state and a non-conducting state to the other one of the conducting state and the non-conducting state in response to receipt of energy released from the input charge when the input charge is detonated by the exploding foil initiator.

20. The initiator assembly of claim 19, wherein the detonation detection switch is a normally open switch that closes momentarily when electrical properties of a non-metallic material layer interposed between a shunt and a pair of switch lands switch from dielectric to electrically conductive in response to receipt of energy released from the input charge when the input charge is detonated by the exploding foil initiator.

21. The initiator assembly of claim 20, wherein surfaces of the first and second switch lands that face the non-metallic material layer are disposed in a common plane.

22. The initiator assembly of claim 20, wherein the non-metallic material layer is formed of polyamide.

23. The initiator assembly of claim 14, wherein the pair of bridge lands are directly mounted to the base.

24. The initiator assembly of claim 14, wherein the bridge element is directly mounted to the base.

25. The initiator assembly of claim 14, further comprising an input sleeve and a grounding switch, the input sleeve having a frangible portion, the input charge being received in the input sleeve, the grounding switch comprising first and second conductive targets and a dielectric material disposed between the first and second conductive targets, the grounding switch being disposed proximate the frangible portion, the frangible portion being configured to break apart from a remainder of the input sleeve and impact the grounding switch to electrically couple the first and second conductive targets to one another in response to detonation of the input charge.

26. A method for operating an initiator assembly, the method comprising:

providing an exploding foil initiator, an input charge and a detonation detection switch, the exploding foil initiator having a base, a pair of bridge lands, a bridge element, and a plurality of non-metallic material layers, the bridge lands being coupled to the base, the bridge element being disposed between the bridge lands, the plurality of non-metallic material layers forming a flyer layer and a barrel, the flyer layer being disposed over the bridge element, the barrel defining a barrel aperture, the barrel being disposed over the flyer layer and positioned such that the barrel aperture is disposed in-line with the bridge element, the input charge being formed of a secondary explosive and disposed in-line with the barrel aperture, the detonation detection switch being mounted to the exploding foil initiator within an area defined by an outer perimeter of the base;

operating the exploding foil initiator to detonate the input charge; and changing a state of the detonating detecting switch with energy released from the detonating input charge.

27. The method of claim 26, wherein a distance between the base and a point on the detonation detection switch that is furthest from the base has a first magnitude, wherein a distance between the base and a point on the input charge that is furthest from the base has a second magnitude, and wherein the first magnitude is less than the second magnitude.

28. The method of claim 26, wherein the detonation detection switch is a normally closed switch.

29. The method of claim 28, wherein detonation detection switch comprises a first switch land, a second switch land and a shunt that is electrically coupled to the first and second switch lands.

30. The method of claim 29, wherein the first and second switch lands and the shut are co-planar.

31. The method of claim 26, wherein the detonation detection switch is configured to change from one of a conducting state and a non-conducting state to the other one of the conducting state and the non-conducting state in response to receipt of energy released from the input charge when the input charge is detonated by the exploding foil initiator.

32. The method of claim 31, wherein the detonation detection switch is a normally open switch that closes momentarily when electrical properties of a non-metallic material layer interposed between a shunt and a pair of switch lands switch from dielectric to electrically conductive in response to receipt of energy released from the input charge when the input charge is detonated by the exploding foil initiator.

33. The method of claim 32, wherein surfaces of the first and second switch lands that face the non-metallic material layer are disposed in a common plane.

34. The method of claim 32, wherein the non-metallic material layer is formed of polyamide.

35. The method of claim 26, wherein the pair of bridge lands are directly mounted to the base.

36. The method of claim 26, wherein the bridge element is directly mounted to the base.

37. An initiator assembly comprising:

a first housing component that defines an interior surface;

a second housing component fixedly coupled to the first housing component, the first and second housing components defining a cavity;

an exploding foil initiator received in the cavity, the exploding foil initiator having a base, a pair of bridge lands, a bridge element, and a plurality of non-metallic material layers, the bridge lands being coupled to the base, the bridge element being disposed between the bridge lands, the plurality of non-metallic material layers forming a flyer layer and a barrel, the flyer layer being disposed over the bridge element, the barrel defining a barrel aperture, the barrel being disposed over the flyer layer and positioned such that the barrel aperture is disposed in-line with the bridge element;

an input charge disposed in the cavity, the input charge being formed of a secondary explosive and disposed in-line with the barrel aperture, the input charge having an axial end that faces the interior surface; and a detonation detection switch coupled to the first housing component and configured to change from one of a closed switch state and an open switch state to the other one of the closed switch state and the open switch state within 500 nano-seconds of the initiation of detonation in the input charge.

38. The initiator assembly of claim 37, wherein the detonation detection switch is configured to change from the one of the closed switch state and the open switch state to the other one of the closed switch state and the open switch state within 250 nano-seconds.

39. The initiator assembly of claim 38, wherein the detonation detection switch is configured to change from the one of the closed switch state and the open switch state to the other one of the closed switch state and the open switch state within 150 nano-seconds.

* * * * *